US006606878B1

(12) United States Patent
Phillips et al.

(10) Patent No.: US 6,606,878 B1
(45) Date of Patent: Aug. 19, 2003

(54) DIVIDER WALL FOR A ROOM AIR CONDITIONER

(75) Inventors: Brian J. Phillips, Smyrna, TN (US); Christopher M. Thompson, Franklin, TN (US); Dewitt D. Rollins, LaVergne, TN (US); Bradley E. Luther, Murfreesboro, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/196,074

(22) Filed: Jul. 16, 2002

Related U.S. Application Data

(63) Continuation-in-part of application No. 10/145,446, filed on May 14, 2002, now abandoned.

(51) Int. Cl.[7] ..... F25D 23/12; F25D 19/00
(52) U.S. Cl. ..... 62/262; 62/298
(58) Field of Search ..... 62/262, 298; 454/201

(56) References Cited

U.S. PATENT DOCUMENTS 3,756,039 A * 9/1973 Riello ..... 62/262
5,081,849 A * 1/1992 Thompson et al. ..... 62/262
5,085,057 A * 2/1992 Thompson et al. ..... 62/262
5,112,024 A * 5/1992 Stanko ..... 248/603
5,687,583 A * 11/1997 Tunekawa et al. ..... 62/404
6,276,156 B1 * 8/2001 da Silva et al. ..... 62/262
6,321,553 B1 * 11/2001 Bushnell et al. ..... 62/262
6,381,978 B1 * 5/2002 Moretti et al. ..... 62/262
6,425,256 B1 * 7/2002 Bushnell et al. ..... 62/262
6,460,363 B1 * 10/2002 Moretti et al. ..... 62/262
6,497,463 B2 * 12/2002 Moretti ..... 312/236

* cited by examiner

*Primary Examiner*—William C. Doerrler
(74) *Attorney, Agent, or Firm*—Robert O. Rice; John F. Colligan; Stephen Krefman

(57) ABSTRACT

A room air conditioner is provided having an evaporator coil located in a front part of the room air conditioner, a condenser coil located in a back part of the room air conditioner, and a wall separating the front part from the back part. The wall prevents a free flow of air between the front part and the back part. A portion of the wall, extending less than a full width of the air conditioner, is formed of metal. An air moving device positioned in the front part creates an air stream flowing through the evaporator coil and out through an air outlet in a front grill of the air conditioner. An air housing surrounds at least a portion of the air moving device and forms an air flow path in the air conditioner, the air housing forming at least a part of the wall. The metal portion of the wall is mounted to the room air conditioner independently of the air housing.

22 Claims, 15 Drawing Sheets

DIVIDER WALL FOR A ROOM AIR CONDITIONER

This application is a continuation-in-part of patent application Ser. No. 10/145,446, now abandoned, filed May 14, 2002.

BACKGROUND OF THE INVENTION

The present invention relates to room air conditioners and more particularly, to room air conditioners having a divider wall.

Room air conditioners typically are positioned in a window or in a through the wall sleeve such that a front part of the air conditioner unit is positioned in a space to be cooled, such as a room, and a back part is exposed to the exterior of the space, typically the outdoors. The interior of the room air conditioner includes a compressor for compressing gaseous refrigerant, a condenser to condense the gaseous refrigerant to a liquid, and to release heat in the process, and an evaporator to allow the refrigerant to evaporate, and to absorb heat in the process. The condenser is positioned in the back part and the evaporator is positioned in the front part. A blower is utilized to draw room air in through an inlet grill, to pass over the evaporator so that heat from the air is given up to the evaporator, and hence cooled, and the air then passes through the blower to pressurize the air, causing it to flow out of the air conditioner through an outlet grill back into the room. Generally, the room air is continuously recirculated from the room and back into the room. A divider wall is typically provided between the front part and the back part of the room air conditioner to prevent the cooled air from flowing into the back part of the air conditioner and to prevent the heat from the condenser from flowing into the front part. In a typical room air conditioner, the dividing wall includes a metal wall extending across the full width of the room air conditioner to provide structural strength to the air conditioner and to provide a mounting location for some components of the air conditioner. The dividing wall is typically secured at a bottom end to a base plate and is connected by a plurality of straps to the condenser coil or its housing.

The dividing wall also may include components of a shroud for the blower which defines the air flow path. Typically, however, the shroud is comprised of a plurality of separate parts which are required to be assembled together.

A room air conditioner is disclosed in U.S. Pat. No. 3,906,741, in which an expanded plastics material is molded to form air flow paths and into which a metallic dividing wall bulkhead 44 is molded. The complex molded shape of the shell requires a complex and expensive mold.

A room air conditioner is disclosed in U.S. Pat. No. 6,276,157 which includes a two-piece air scroll and a metal dividing wall extending across the full width of the air conditioner.

It would be an improvement in the art if there were provided a dividing wall structure utilizing a minimum of low cost parts which can be easily assembled together to provide the necessary structural integrity and air flow path construction for a room air conditioner.

SUMMARY OF THE INVENTION

The present invention provides for a room air conditioner having a dividing wall structure made of a small number of parts there are easily manufactured and assembled to provide structural integrity to the room air conditioner and to define an air flow path in the air conditioner.

A portion of the dividing wall, which can be formed of an expanded plastic material, such as expanded polystyrene, surrounds at least a portion of an air moving device, such as a blower wheel, and forms an air flow path in the air conditioner which extends through an evaporator coil and a front panel of the air conditioner. The wall also includes a metal component which extends less than a full width of the air conditioner and which is secured independently of the expanded plastic wall portion.

Preferably the metal wall member includes a vertical bend and more preferably, two vertical bends so that the metal wall member comprises generally a Z-shape to enhance the strength of the wall.

The expanded plastic portion of the wall is preferably formed in two parts, a first part being an air scroll shaped cavity for receiving the blower wheel and the second part comprising an air inlet for directing an air flow into the blower wheel and an air outlet passage for directing an air flow from the air scroll to the air outlet. In an embodiment, the two separate parts have complementarily shaped portions permitting the parts to be joined together in a mating relationship. The second part may have a ledge portion formed to engage with a complementarily shaped portion in the front panel of the air conditioner to permit the parts to be mated together without requiring the use of additional fasteners. A foam sealant can be used between the two parts to seal the parts together and to seal the air housing to an outer wrapper of the room air conditioner.

DETAILED DESCRIPTION OF THE PREFERRED EMBODIMENT

The present invention relates to a room air conditioner which typically is positioned in a window or in a through the wall sleeve such that a front part of the air conditioner unit is positioned in a space to be cooled and a back part is exposed to the exterior of the space. While the present invention can be utilized in many different types of room air conditioners, it is shown and described in one particular room air conditioner unit, for illustrative purposes, however the scope of the claims should not be limited to the embodiment illustrated and described.

Figure 1:
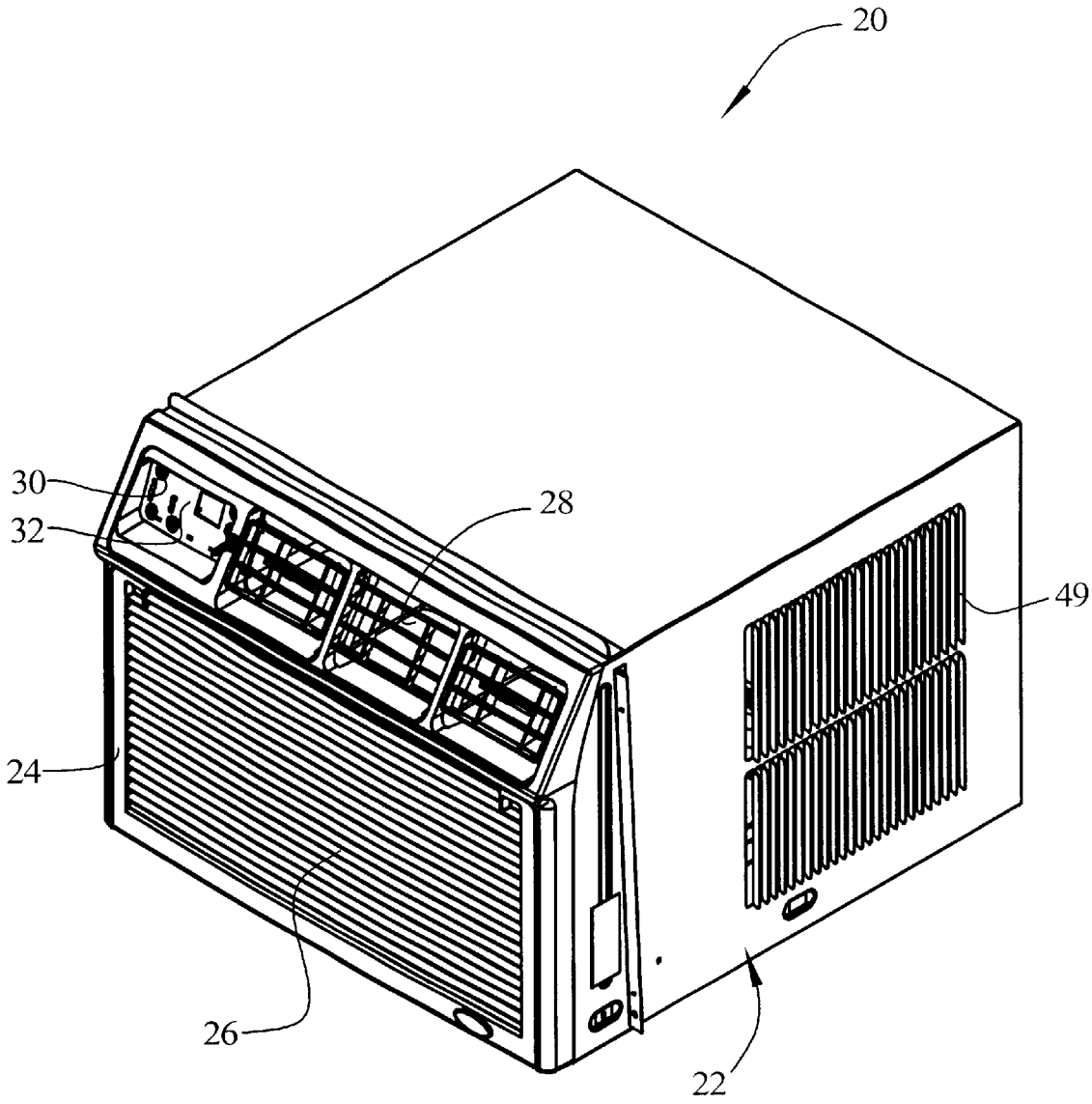
FIG. 1 is a perspective view of a room air conditioner in which the present invention can be utilized.
Figure 2:
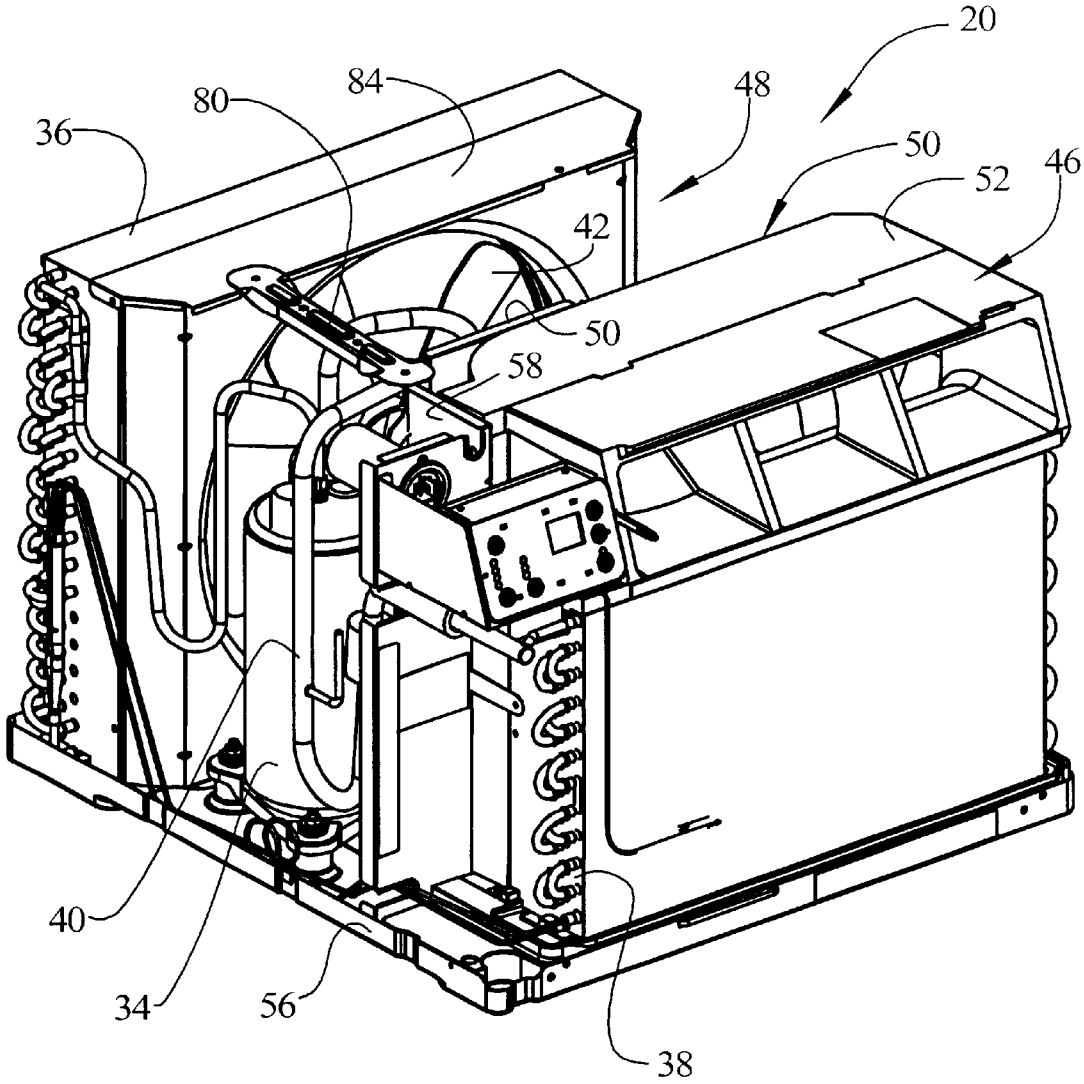
FIG. 2 is a front perspective view of the room air conditioner of FIG. 1, with the outer wrapper removed to expose interior components.
Figure 3:
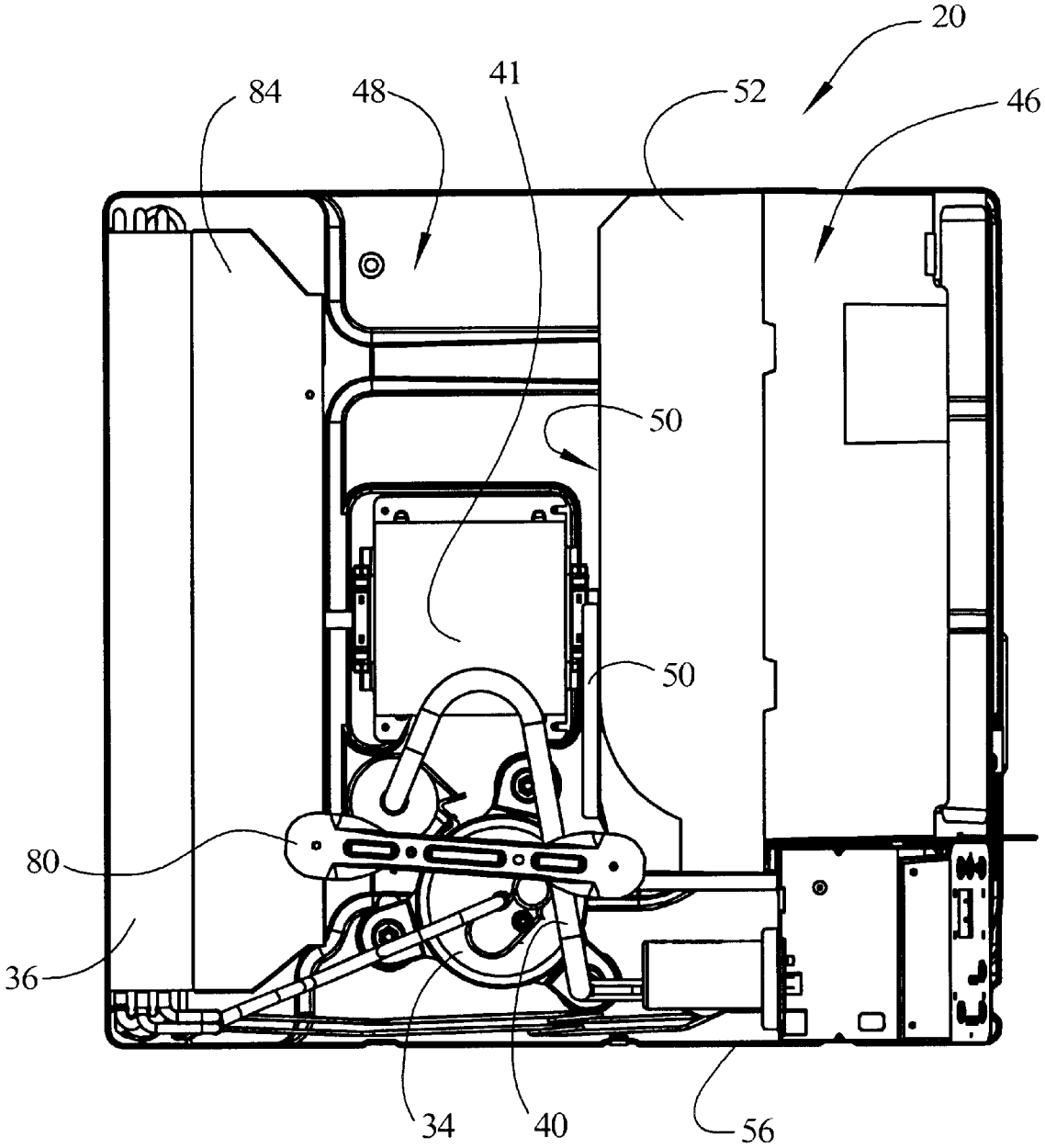
FIG. 3 is a plan view of the interior of the room air conditioner of FIG. 1.
Figure 4:
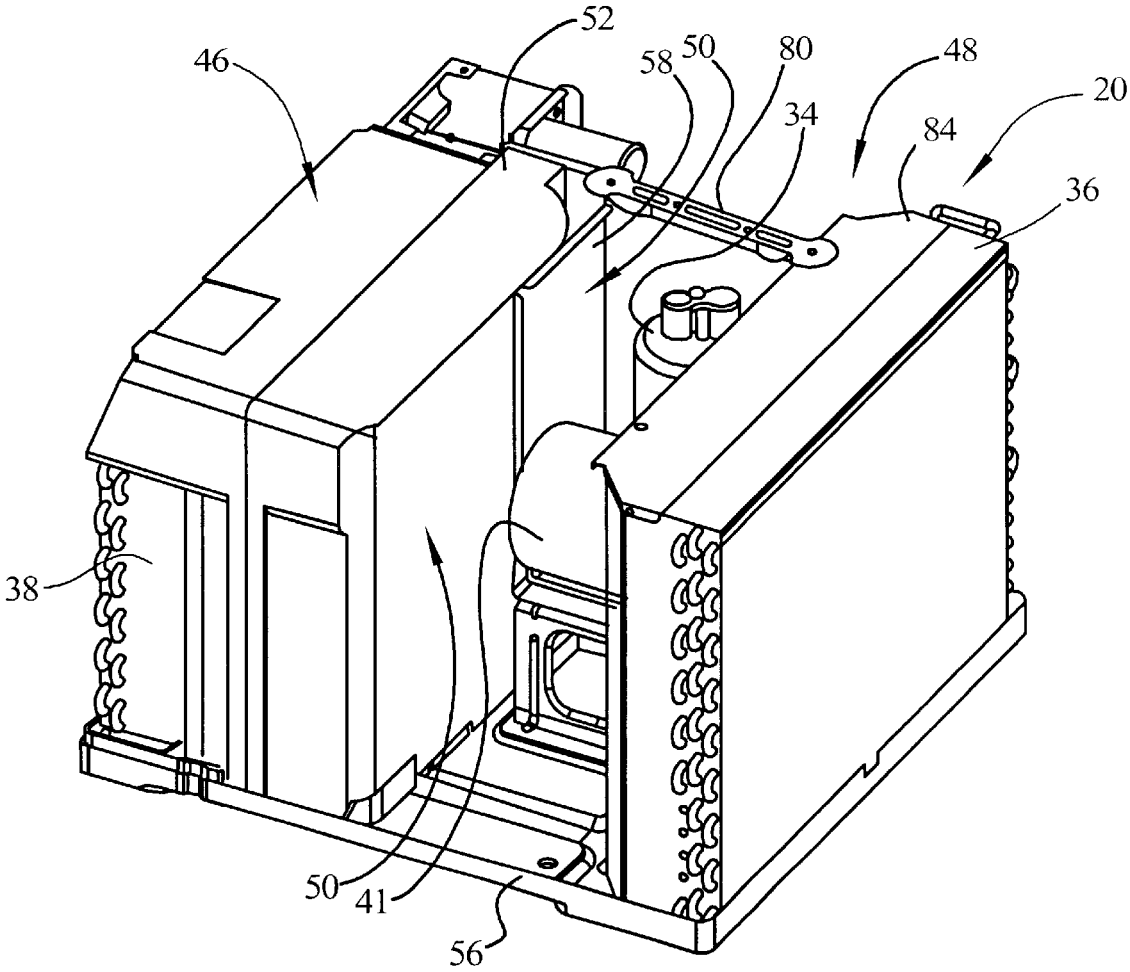
FIG. 4 is a rear perspective view of the room air conditioner of FIG. 1, with the outer wrapper removed.
Figure 5:
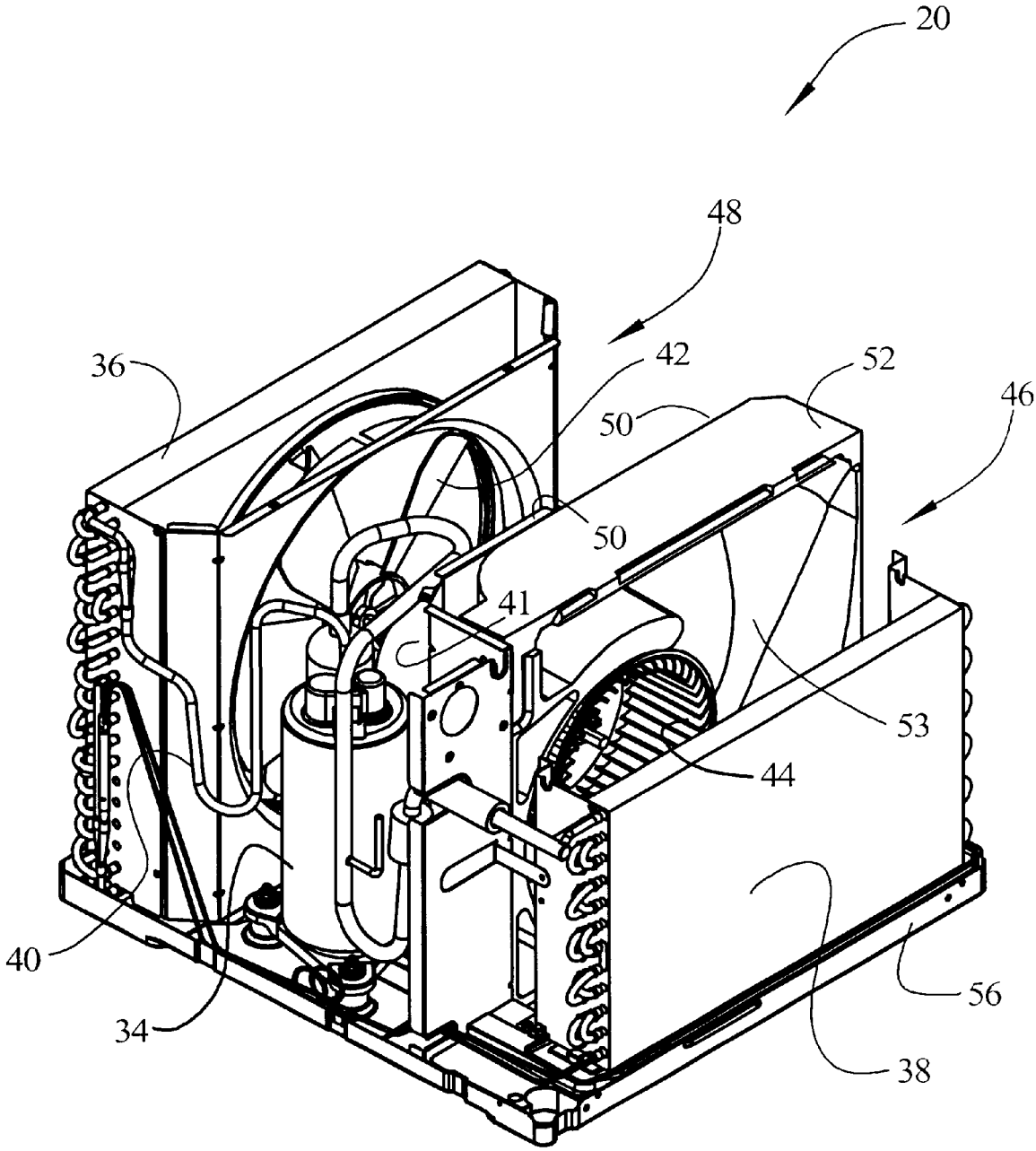
FIG. 5 is a front perspective view of the room air conditioner of FIG. 2, with certain interior components removed.

In FIG. 1 there is illustrated a room air conditioner 20 embodying the principles of the present invention which comprises a cabinet portion 22 facing the interior of a space to be cooled, including a front panel 24 with an air flow inlet grill 26 and an air flow outlet grill 28. A plurality of controls 30 are arranged on a control panel 32 located on the front panel 24. Room air is pulled into the air flow inlet grill 26 and discharged back into the room through the air flow outlet grill 28.

In FIGS. 2–5, some of the interior components of the room air conditioner 20 are illustrated including a compressor 34, a condenser coil 36 and an evaporator coil 38, all interconnected by refrigeration lines 40 as is known in the art. A single motor 41 is used to drive a condenser fan 42 and an evaporator blower wheel 44, also as is known.

The air conditioner 20 is divided into a front part 46 which contains the evaporator coil 38 and the evaporator blower wheel 44, and a back part 48 which contains the condenser coil 36, the compressor 34 and air outlets 49 (FIG. 1). A divider wall 50 is provided between the front part 46 and the back part 48, and generally there is no air flow between the front part 46 and the back part 48.

The evaporator blower wheel 44 is enclosed in a shroud 52 which defines a first air flow path which extends through the evaporator coil 38 and into the blower wheel where the air is pressurized and is directed to a scroll shaped passage 53 leading to the air outlet grill 28.

Figure 6:
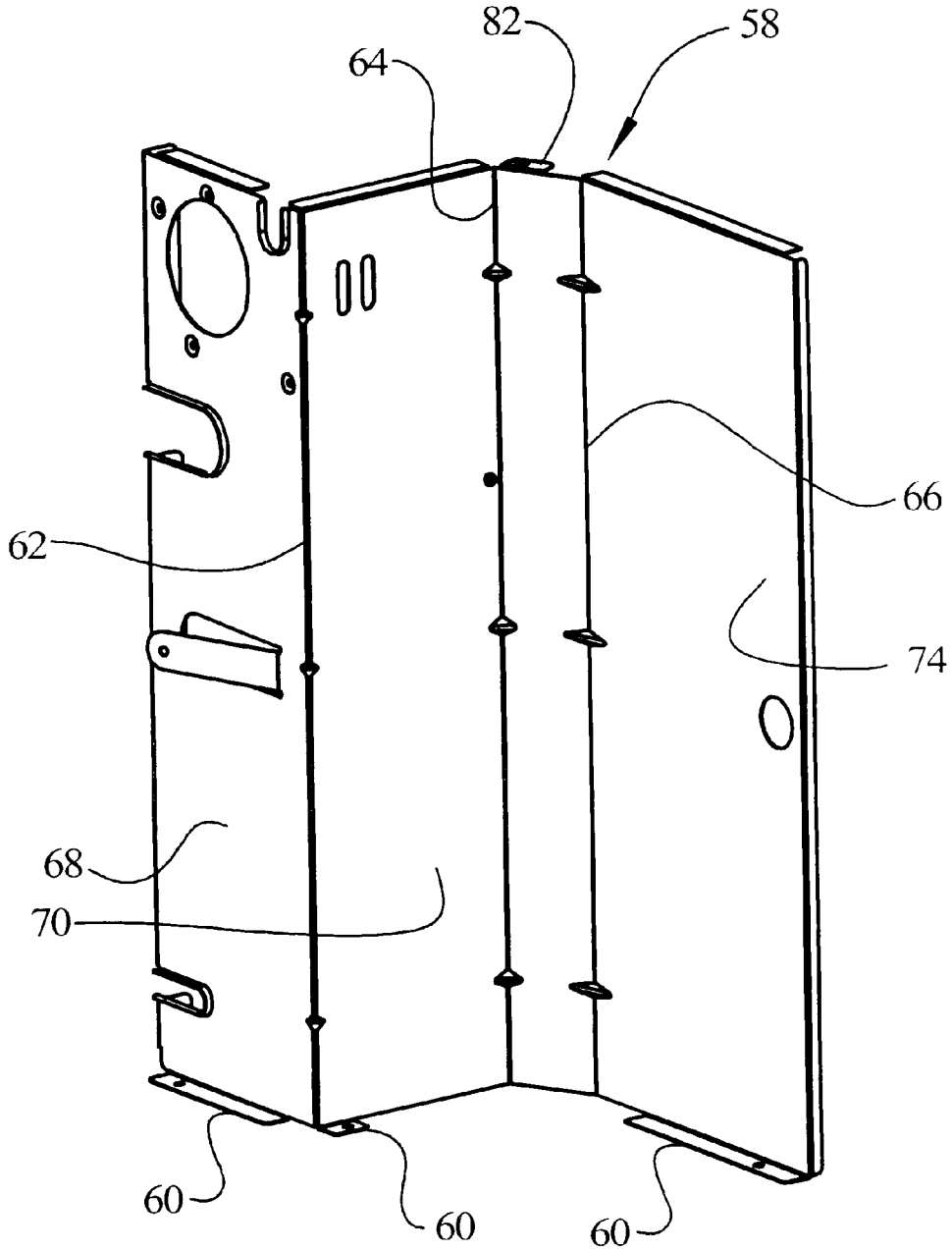
FIG. 6 is a front perspective view of the metal divider wall portion.
Figure 7:
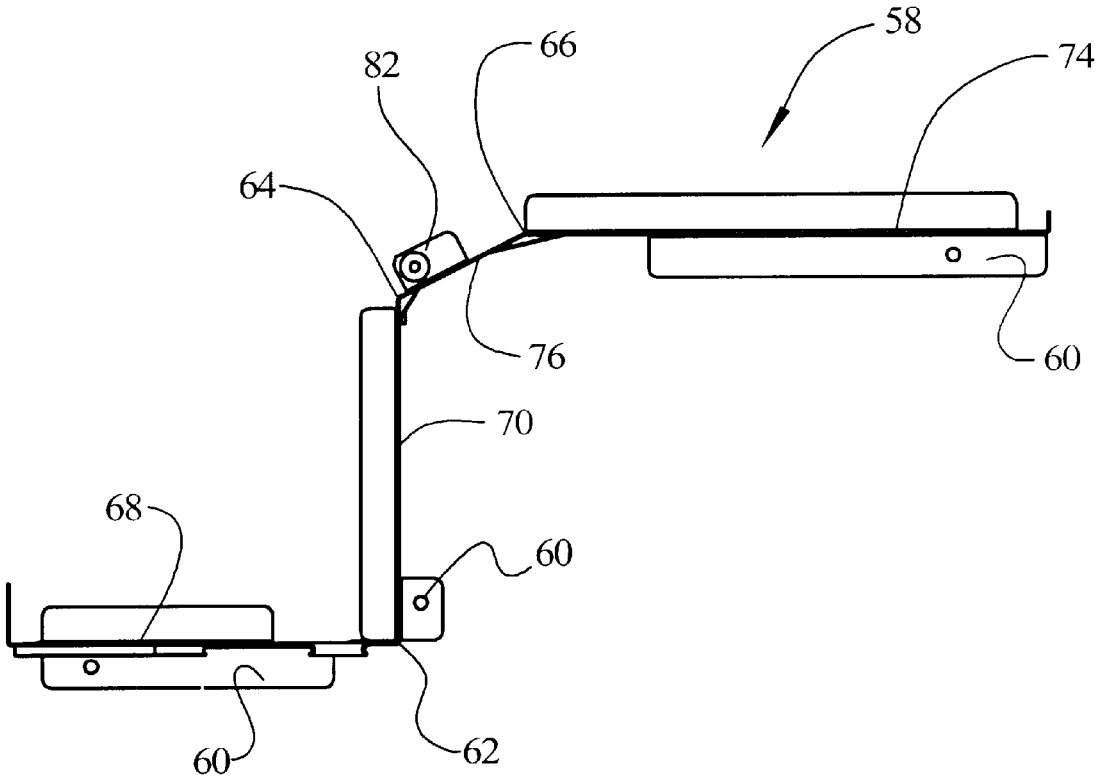
FIG. 7 is a plan view of the metal divider wall portion of FIG. 6.
Figure 8:
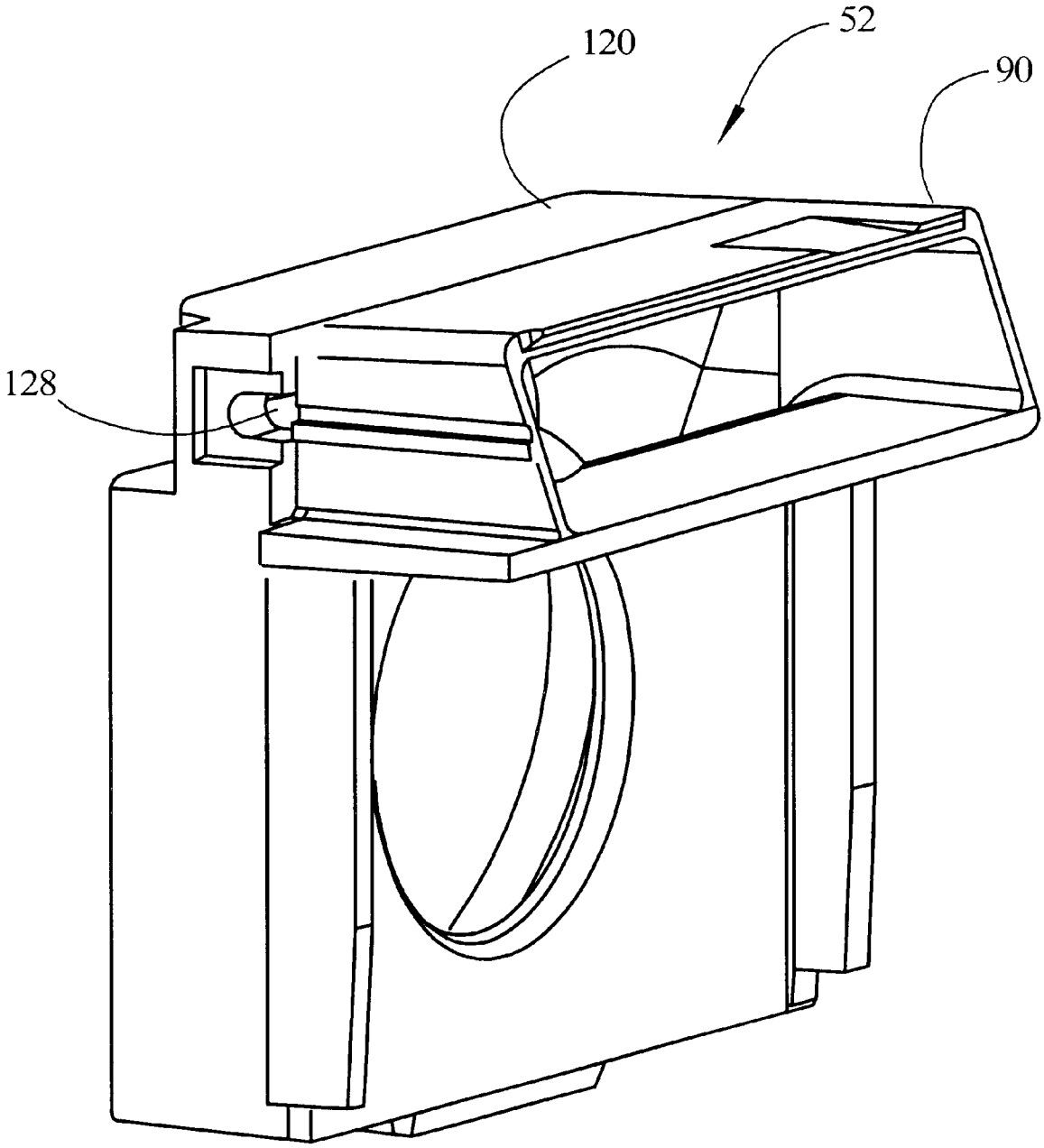
FIG. 8 is a front perspective view of the expanded plastic divider wall.
Figure 9:
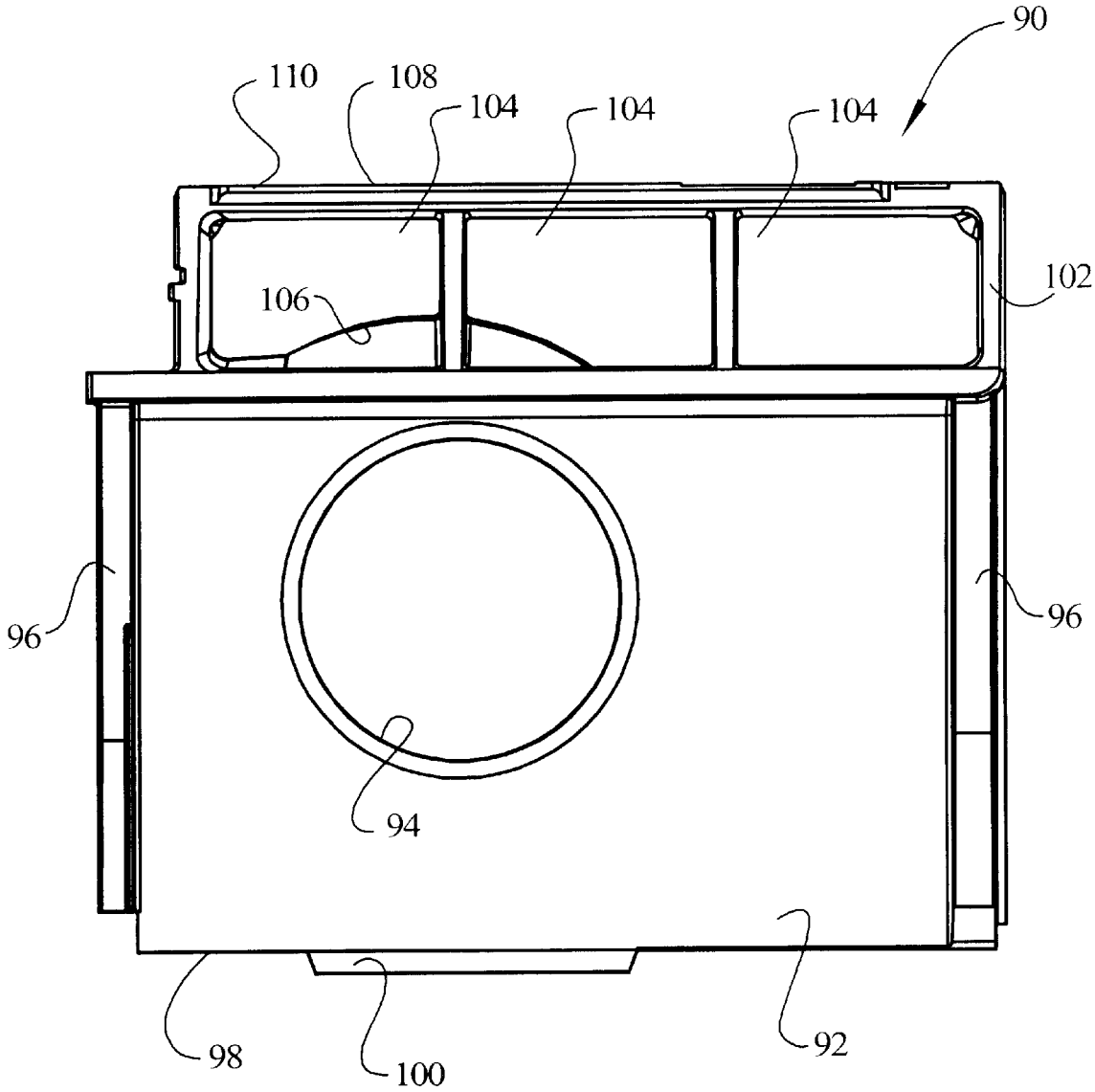
FIG. 9 is a front elevational view of the front portion of the divider wall.
Figure 10:
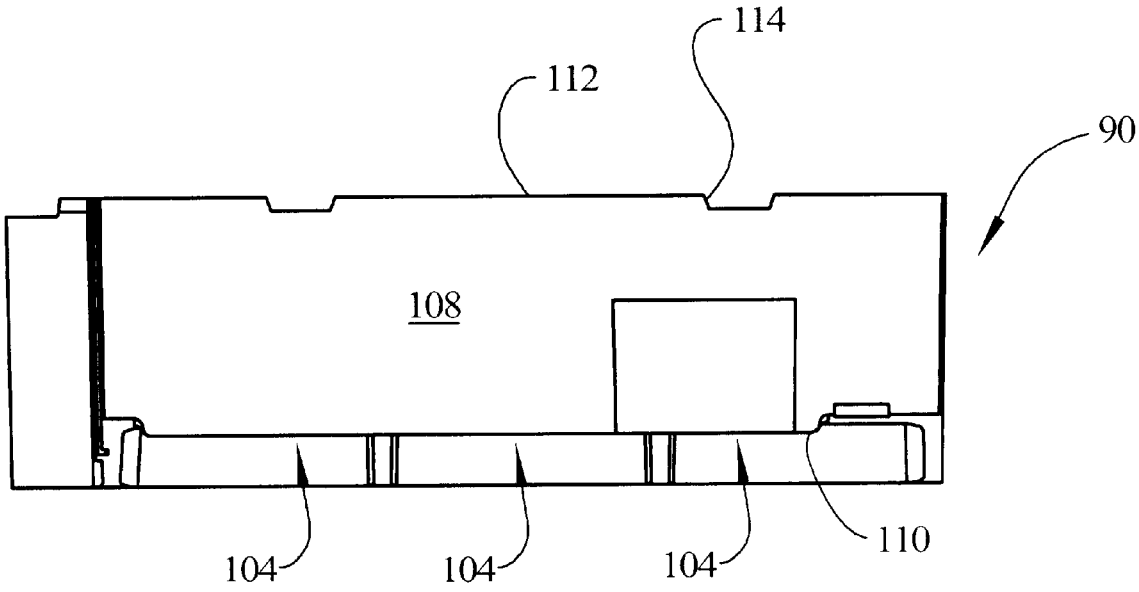
FIG. 10 is a plan view of the front portion of the divider wall of FIG. 9.
Figure 11:
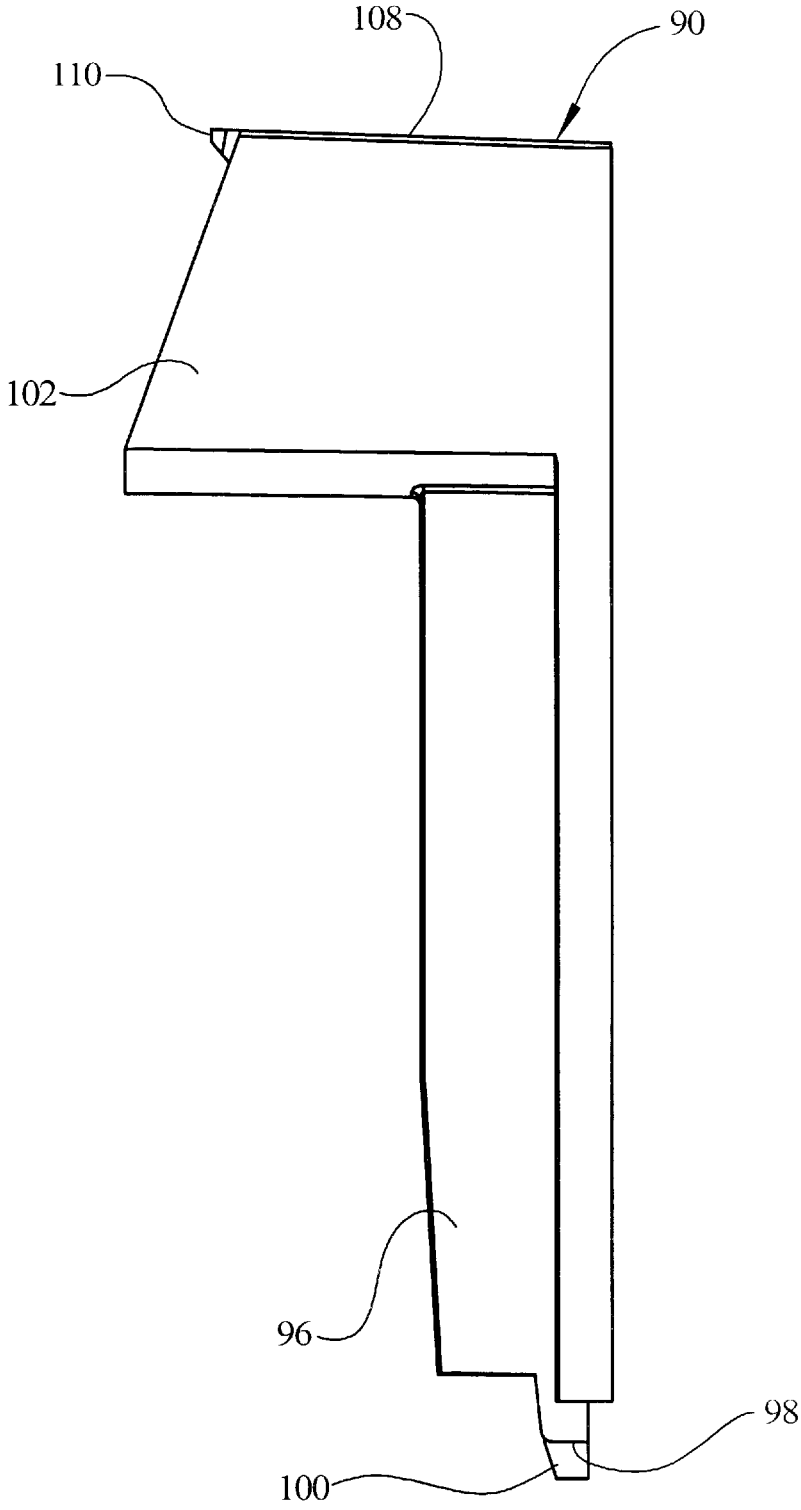
FIG. 11 is a side elevational view of the front portion of the divider wall of FIG. 9.
Figure 12:
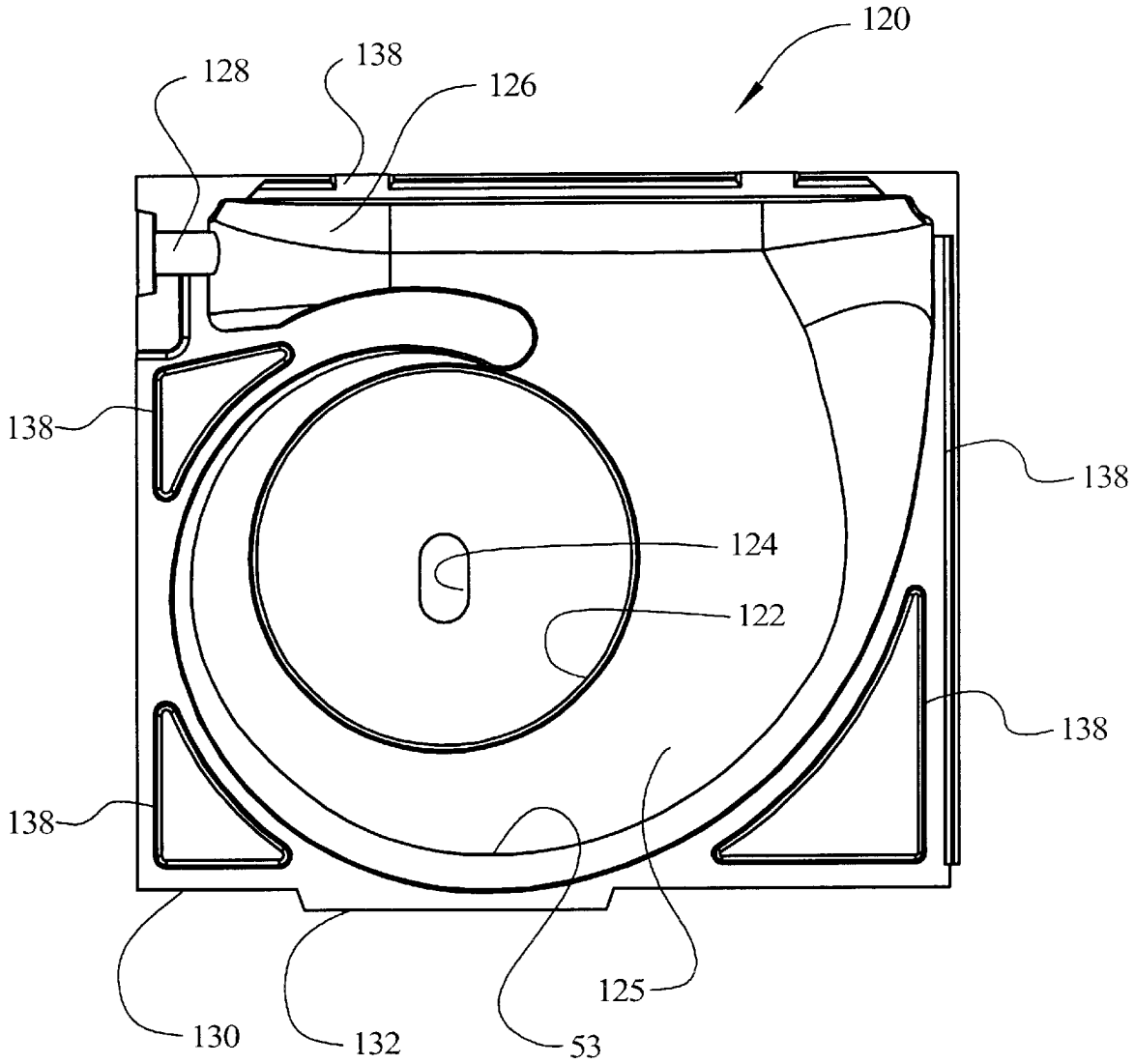
FIG. 12 is a front elevational view of a rear portion of the divider wall.
Figure 13:
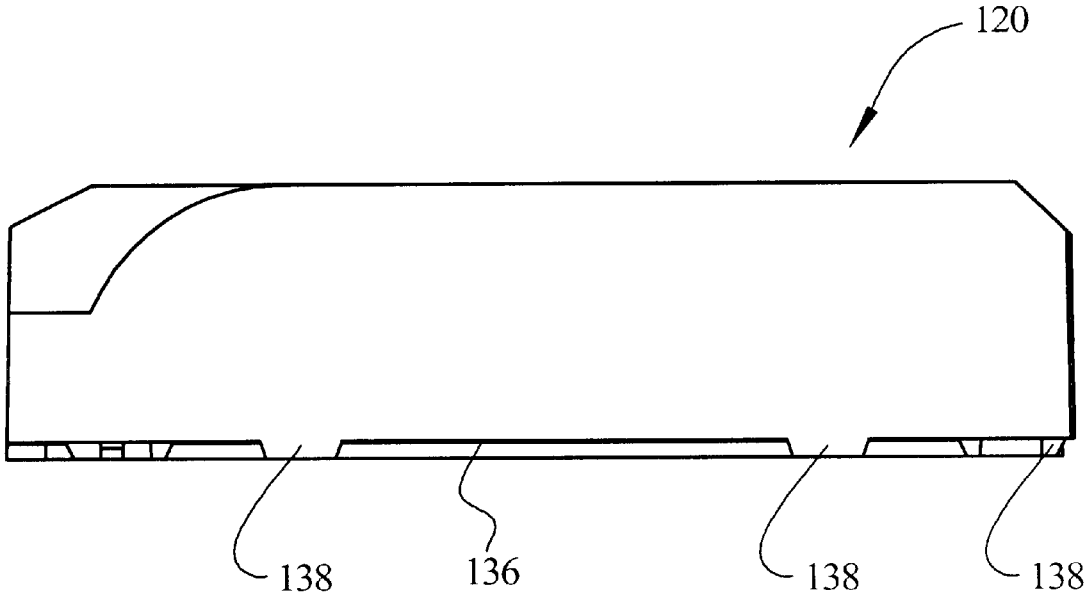
FIG. 13 is a plan view of the rear portion of the divider wall of FIG. 11.
Figure 14:
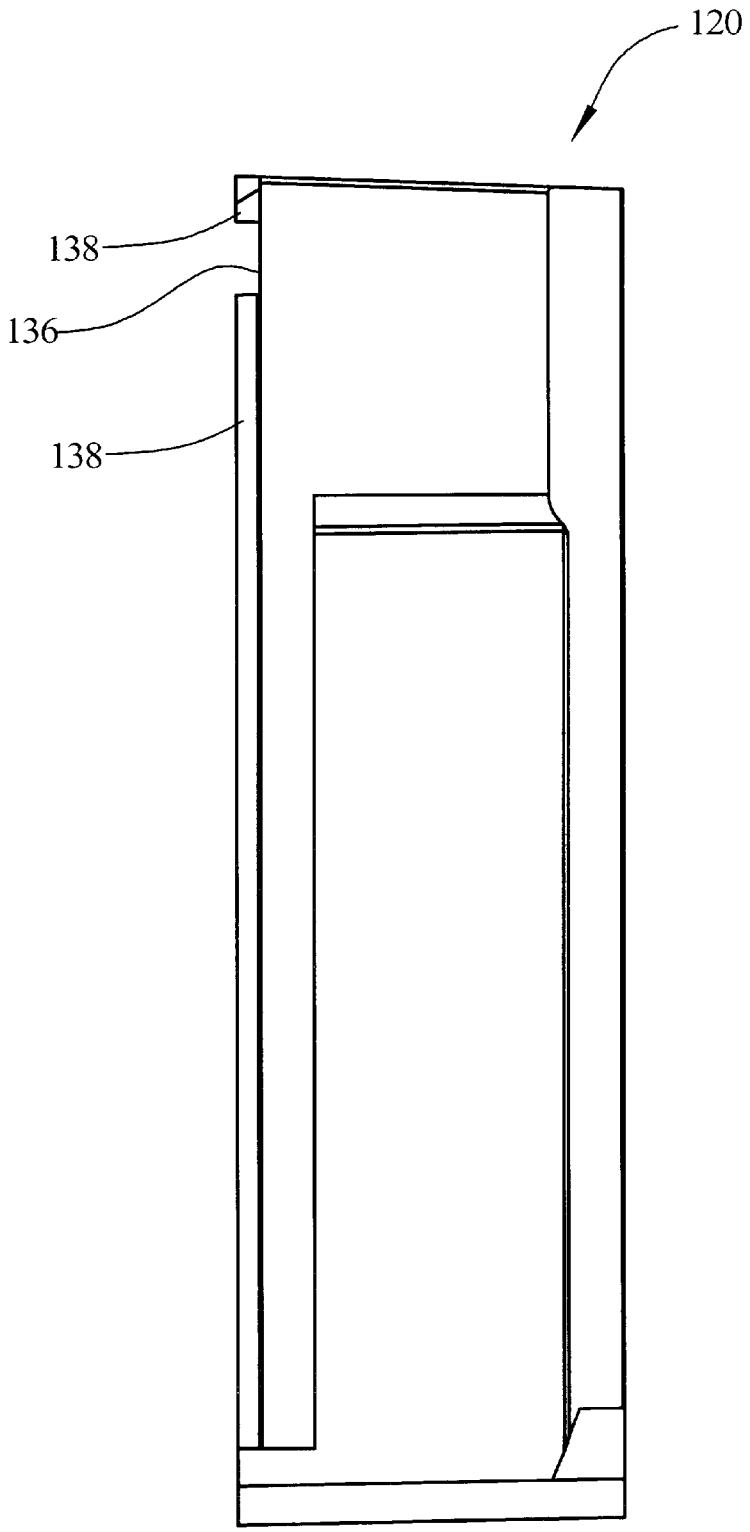
FIG. 14 is a right side elevational view of the rear portion of the divider wall of FIG. 11.
Figure 15:
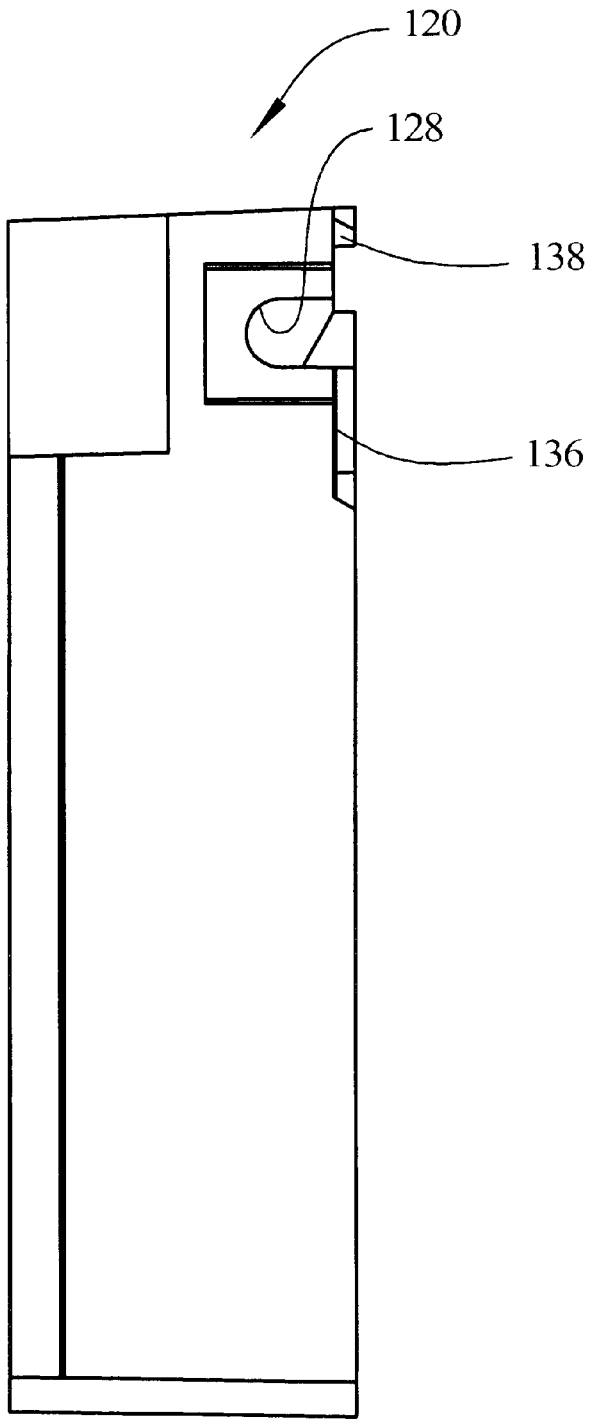
FIG. 15 is a left side elevational view of the rear portion of the divider wall of FIG. 11.

The room air conditioner 20 includes a metal chassis or base plate 56 to which a number of the interior components can be mounted. The dividing wall 50 has two portions, a first portion 58 is shown in isolated detail in FIGS. 5 and 6. The first portion 58 preferably is formed of a metal material and is independently secured to the chassis 56 by means of flanges 60 formed at a lower end of the metal wall portion 58. The metal wall portion 58 also includes at least one, and preferably at least two vertical bends 62, 64, and in the embodiment illustrated in FIG. 5, a third vertical bend 66 such that the metal wall portion 58 will have increased strength and rigidity and will assume a general Z-shape as viewed from above. The metal wall portion includes a first planar segment 68 which is joined to a second planar segment 70 via the bend 62 such that the first planar segment 68 is substantially perpendicular to the second planar segment 70. A third planar segment 74 is joined to the second planar segment 70 via the second vertical bend 64 and third vertical bend 66 and an intermediate segment 76 such that the third segment 74 is substantially perpendicular to the second segment 70. The metal wall portion 58 can be easily formed as a metal stamping including various cut outs and mounting configurations for various components of the room air conditioner. The metal wall portion 58 preferably is stabilized by means of a strap 80 secured at one end to an upper flange 82 of the metal wall portion and at a second end to the condenser coil 36 or a housing shroud 84 for the condenser fan 42. The metal dividing wall portion 58 preferably extends less than a full width of the room air conditioner, and most preferably no more than one-half of the width of the room air conditioner. Further, preferably only a single strap 80 is used to stabilize the upper portion of the metal dividing wall portion 58.

The shroud 52 also forms a portion of the dividing wall 50 and the metal dividing wall portion 58 abuts against, but is mounted independently of the shroud 52. That is, the metal dividing wall portion 58 is not secured directly to the shroud 52.

The shroud 52 is shown in isolated detail in FIGS. 8–15. The shroud 52 can be formed in two separately molded pieces, both preferably formed of an expanded plastic material such as expanded polystyrene. A front portion 90 of the shroud 52 is shown in isolated detail in FIGS. 9–11 and includes a central planar portion 92 having a hole 94 therethrough to allow passage of air to the evaporator blower 44. Sidewalls 96 extend forwardly of the planar wall 92 to provide an air plenum chamber behind the evaporator coil 38 so that air is permitted to flow through the entire volume of the evaporator coil 38 before flowing through the opening 94 to the evaporator blower 44. A lower edge 98 of the front portion 90 includes a tab 100 which can be received in a complementarily shaped portion of the chassis 56 or a separate drip pan (not shown) to hold the front portion 90 in place relative to the chassis 56.

An upper portion 102 extends forwardly above the evaporator coil 38 and includes a plurality of air flow passages 104 which communicate through an opening 106 with the scroll shape passage 53 surrounding the blower 44. These air flow passages 104 allow the air which has been pressurized by the evaporator blower 44 to exit through the outlet grill 28 in the front panel 24. A top edge 108 of the upper portion 102 includes a forwardly extending flange 110 which can be received in a complementarily shaped recess in a backside of the front panel 24 to securely hold and retain the two parts in a mating relationship without the use of additional fasteners. A rear edge 112 of the front portion 90 includes contoured components 114 such as alternating recesses and protrusions for mating purposes as described below. The shroud 52 includes a rear portion 120 which is shown in isolated detail in FIGS. 12–15. The rear portion 120 includes the scroll shape passage 53 as well as a recess 122 for receiving the blower wheel 44. An opening 124 is provided for receiving a shaft from the motor 41. The scroll shape passage 53 opens up into a plenum chamber 126 which communicates with the opening 106 in the front part 90 to permit the air which has been pressurized by the evaporator blower 44 to flow into the air passages 104 in the front part. An exhaust opening 128 may be provided from the plenum chamber 126 which can be controlled by an exhaust door (not shown) to selectively exhaust room air through the air conditioner and to the outlet vents 49.

A bottom edge 130 of the rear portion 120 includes a tab 132 for engaging the chassis 56 or drip pan carried in the chassis to securely locate and retain the rear portion 120.

A rear wall 125 of the scroll shaped chamber 53 prevents air flow between the front part 46 and rear part 48 of the room air conditioner and, as such, forms a portion of the dividing wall 50.

A front edge 136 of the back portion 120 is contoured, such as with protrusions 138 which mate with the recesses 114 in the front part 90 to align and secure the front part 90 and rear part 120 together. If desired, a foam sealant can be applied between the front part 90 and rear part 120 to securely hold and retain the two portions together.

As is apparent from the foregoing specification, the invention is susceptible of being embodied with various alterations and modifications which may differ particularly from those that have been described in the preceding specification and description. For example, various components of the control circuitry illustrated in FIG. 4 may be used only for some of the embodiments described above, while not being necessary for other embodiments. Further, several of the embodiments can be used in combination in a single refrigeration appliance and each of the embodiments can be used in isolation. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A room air conditioner comprising:

an evaporator coil located in a front part of said room air conditioner, a condenser coil located in a back part of said room air conditioner, a wall separating said front part from said back part, said wall preventing a free flow of air between said front part and said back part, a portion of said wall, extending less than a full width of said air conditioner, being formed of metal, an air moving device positioned in said front part to create an air stream flowing through said evaporator coil and out through an air outlet in a front grill of said air conditioner, an air housing surrounding at least a portion of said air moving device and forming an air flow path in said air conditioner, said air housing forming at least a part of said wall, said metal portion of said wall being mounted to said room air conditioner independently of said air housing and not being secured directly to said air housing.

2. A room air conditioner according to claim 1, wherein said air housing is formed of an expanded polystyrene material.

3. A room air conditioner according to claim 1, including a support strap extending from said condenser coil to said metal wall portion.

4. A room air conditioner according to claim 1, wherein said metal wall portion has a generally Z shape.

5. A room air conditioner according to claim 1, wherein said metal wall portion is formed of three segments, each segment being positioned perpendicular to an adjacent segment.

6. A room air conditioner according to claim 1, wherein said metal wall portion extends approximately half of the width of said room air conditioner.

7. A room air conditioner according to claim 1, wherein said air housing is formed in two parts, each of expanded polystyrene, a first part comprising an air scroll shaped cavity for receiving said blower wheel, and said second part comprising an air inlet for directing an air flow into said blower and an air outlet passage for directing an air flow from said air scroll to said air outlet.

8. A room air conditioner according to claim 7, wherein said two separate parts have complementarily shaped portions permitting said parts to be joined together in a mating relationship.

9. A room air conditioner according to claim 1, wherein said room air conditioner includes a front panel and said second part has a ledge portion formed to engage with a complementarily shaped portion in said front panel to permit said parts to be mated together without requiring the use of additional fasteners.

10. A room air conditioner according to claim 1, including a foam sealant between said two parts to seal said parts.

11. A room air conditioner according to claim 1, including a control box secured to said metal wall portion.

12. A room air conditioner comprising:

a front part of said air conditioner including a front panel, an evaporator coil located in said front part behind said front panel, a blower wheel positioned in said front part to create an air stream flowing in through an air inlet in said front panel, through said evaporator coil and out through an air outlet in said front panel, an air housing surrounding said blower wheel and forming an air flow path in said air conditioner, said air housing forming a wall separating said front part from a back part, a condenser coil and a compressor located in said back part, a metal wall portion extending less than a full width of said air conditioner abutting against said air housing wall and being secured to said room air conditioner independently of said air housing and not being secured directly to said air housing.

13. A room air conditioner according to claim 12, wherein said air housing is formed of an expanded polystyrene material.

14. A room air conditioner according to claim 12, including a support strap extending from said condenser coil to said metal wall portion.

15. A room air conditioner according to claim 12, wherein said metal wall portion has a generally Z shape.

16. A room air conditioner according to claim 12, wherein said metal wall portion is formed of three portions, each portion being positioned perpendicular to an adjacent portion.

17. A room air conditioner according to claim 12, wherein said metal wall portion extends approximately half of the width of said room air conditioner.

18. A room air conditioner according to claim 12, wherein said air housing is formed in two parts, each of expanded polystyrene, a first part comprising an air scroll shaped cavity for receiving said blower wheel, and said second part comprising an air inlet for directing an air flow into said blower and an air outlet passage for directing an air flow from said air scroll to said air outlet.

19. A room air conditioner according to claim 18, wherein said two separate parts have complementarily shaped portions permitting said parts to be joined together in a mating relationship.

20. A room air conditioner according to claim 12, wherein said room air conditioner includes a front panel and said second part has a ledge portion formed to engage with a complementarily shaped portion in said front panel to permit said parts to be mated together without requiring the use of additional fasteners.

21. A room air conditioner according to claim 12, wherein said metal wall portion has a plurality of vertical bends therein.

22. A room air conditioner comprising:

a front part of said air conditioner including a front panel, an evaporator coil located in said front part behind said front panel, a blower wheel positioned in said front part to create an air stream flowing in through an air inlet in said front panel, through said evaporator coil and out through an air outlet in said front panel, an air housing formed of an expanded polystyrene material surrounding said blower wheel and forming an air flow path in said air conditioner, said air housing being formed in two parts, each of expanded polystyrene, a first part comprising an air scroll shaped cavity for receiving said blower wheel, and said second part comprising an air inlet for directing an air flow into said blower and an air outlet passage for directing an air flow from said air scroll to said air outlet, said air housing forming a wall separating said front part from a back part, a condenser coil and a compressor located in said back part, a metal wall portion extending less than a full width of said air conditioner abutting against said air housing wall and being secured to said room air conditioner independently of said air housing and not being secured directly to said air housing, said metal wall portion having a generally Z shape.

* * * * *